US005660129A

United States Patent [19]

Murata et al.

[11] Patent Number: 5,660,129

[45] Date of Patent: Aug. 26, 1997

[54] SEWING MACHINE

[75] Inventors: Kunihiko Murata, Tsushima; Hideo Kawaguchi, Tajimi, both of Japan

[73] Assignee: Brother Kogyo Kabushiki Kaisha, Nagoya, Japan

[21] Appl. No.: 596,620

[22] Filed: Feb. 5, 1996

[30] Foreign Application Priority Data

Feb. 9, 1995 [JP] Japan ..... 7-021797

[51] Int. Cl.[6] ..... D05B 19/12; D05B 69/12

[52] U.S. Cl. ..... 112/470.04; 112/220

[58] Field of Search ..... 112/470.04, 220, 112/221, 277, 181, 470.01

[56] References Cited

U.S. PATENT DOCUMENTS 5,088,429 2/1992 Kanegae ..... 112/220 X
5,189,971 3/1993 Frankel et al. ..... 112/220
5,271,346 12/1993 Mori ..... 112/220
5,458,075 10/1995 Tice et al. .

FOREIGN PATENT DOCUMENTS 3-234292 10/1991 Japan .
7-657 1/1995 Japan .

*Primary Examiner*—Peter Nerbun
*Attorney, Agent, or Firm*—Oliff & Berridge

[57] ABSTRACT

A sewing machine including a needle bar to which a sewing needle is secured, a needle-bar drive motor which reciprocates the needle bar, a hook, a hook drive motor which rotates the hook, a speed detector which detects a rotation speed of the needle-bar drive motor, an information obtaining device which obtains information indicating that the rotation speed of the needle-bar drive motor will change, and a control device which controls, based on the detected rotation speed of the needle-bar drive motor and the obtained information, the hook drive motor so that the hook is rotated in synchronism with the reciprocation of the needle bar.

16 Claims, 4 Drawing Sheets

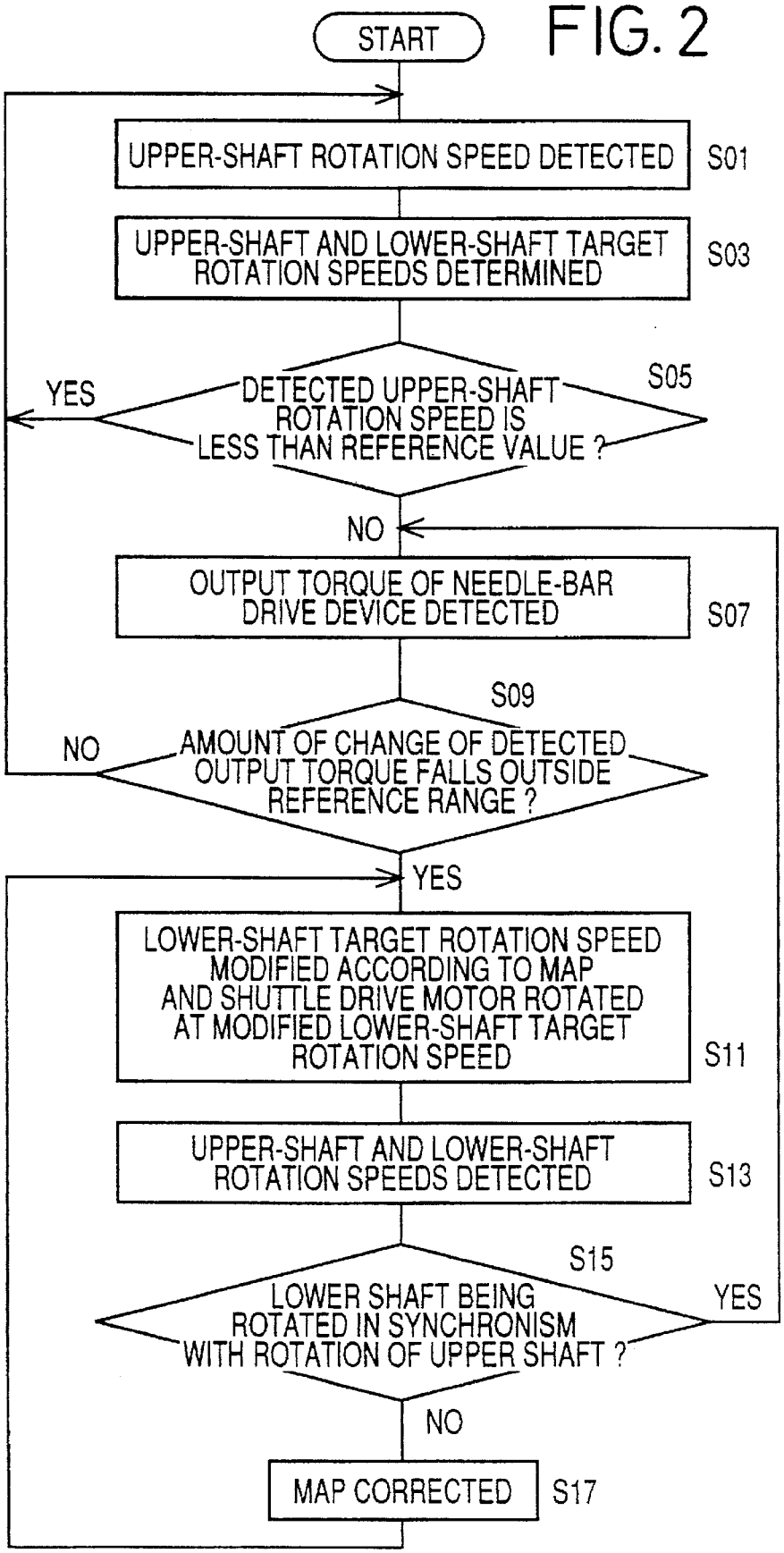
FIG. 2
START
UPPER-SHAFT ROTATION SPEED DETECTED
S01
UPPER-SHAFT AND LOWER-SHAFT TARGET ROTATION SPEEDS DETERMINED
S03
DETECTED UPPER-SHAFT ROTATION SPEED IS LESS THAN REFERENCE VALUE ?
S05
YES
NO
OUTPUT TORQUE OF NEEDLE-BAR DRIVE DEVICE DETECTED
S07
AMOUNT OF CHANGE OF DETECTED OUTPUT TORQUE FALLS OUTSIDE REFERENCE RANGE ?
S09
NO
YES
LOWER-SHAFT TARGET ROTATION SPEED MODIFIED ACCORDING TO MAP AND SHUTTLE DRIVE MOTOR ROTATED AT MODIFIED LOWER-SHAFT TARGET ROTATION SPEED
S11
UPPER-SHAFT AND LOWER-SHAFT ROTATION SPEEDS DETECTED
S13
LOWER SHAFT BEING ROTATED IN SYNCHRONISM WITH ROTATION OF UPPER SHAFT ?
S15
YES
NO
MAP CORRECTED
S17

SEWING MACHINE

BACKGROUND OF THE INVENTION

1. Field of the Invention

The present invention relates to a sewing machine which forms stitches by utilizing the cooperation of a needle bar and a hook or shuttle (i.e., thread-loop catching device), and in particular to such a sewing machine which includes respective motors for driving a needle bar and a hook.

2. Related Art Statement

A sewing machine forms stitches by utilizing the cooperation of a needle bar which is reciprocated when an upper shaft is rotated and a hook which is rotated together with a lower shaft. In the sewing machine, the needle bar is moved downward so that a needle thread is conveyed into a sewing bed and, when the needle bar is moved upward, the hook is rotated to catch the needle thread, so that a stitch is formed in a material being sewn, such as cloth or leather. The sewing machine may be of a type which includes an upper shaft which is directly connected to an electric motor and a lower shaft which is connected to the upper shaft via pulleys, a belt, etc. so that the rotation of the upper shaft is transmitted to the lower shaft. In this case, since the upper and lower shafts are mechanically connected to each other, the two shafts are rotated in synchronism with each other. Accordingly, good stitches are produced.

Recently, there has been proposed a sewing machine which includes respective electric motors for rotating an upper and a lower shaft. This arrangement contributes to increasing the degree of freedom of machine design and/or the degree of compactness of machine construction. This sewing machine is disclosed in, e.g., Japanese Patent Application laid open for inspection under Publication No. 3(1991)-234292. In this second case, the respective rotations of the upper and lower shafts should be synchronized with each other. To this end, the sewing machine may include an encoder for detecting a rotation speed or phase of a needle-bar drive motor and a control device for controlling a hook drive motor based on the detected rotation speed or phase of the needle-bar drive motor. This sewing machine is disclosed in, e.g., Japanese Patent Application laid open for inspection under Publication No. 7(1995)-657.

However, the above-indicated second sewing machine suffers from the following problem concerning the synchronization of respective rotations of the needle-bar and hook drive motors: When the sewing machine forms stitches in a lapped portion of material or sews varying plies or thicknesses of material, a resistance exerted to a sewing needle secured to the needle bar increases, so that the rotation speed of the needle-bar drive motor decreases. In this case, the control device controls the hook drive motor so that the rotation speed thereof decreases as the rotation speed of the needle-bar drive motor does. However, if the sewing machine is operated at a high speed, i.e., the needle bar is reciprocated at a high speed, then the hook drive motor may not follow up the decreasing of rotation speed of the needle-bar drive motor, so that the hook drive motor may not be rotated in synchronization with the rotation of the needle-bar drive motor and the hook may even fail to catch the loop of a needle thread conveyed by the sewing needle secured to the needle bar. Thus, good stitches may not be produced in the work sheet.

SUMMARY OF THE INVENTION

It is therefore an object of the present invention to provide a sewing machine which reliably maintains the synchronization of respective rotations of a needle-bar and a hook drive motor even if the rotation speed of the needle-bar drive motor abruptly changes while the sewing machine forms stitches in a work sheet.

The above object has been achieved according to the present invention, which provides a sewing machine comprising a needle bar to which a sewing needle is secured, a needle-bar drive motor which reciprocates the needle bar, a hook, a hook drive motor which rotates the hook, a speed detector which detects a rotation speed of the needle-bar drive motor, an information obtaining device which obtains information indicating that the rotation speed of the needle-bar drive motor will change, and a control device which controls, based on the detected rotation speed of the needle-bar drive motor and the obtained information, the hook drive motor so that the hook is rotated in synchronism with the reciprocation of the needle bar.

In the sewing machine constructed as described above, the information obtaining device obtains information indicating that the rotation speed of the needle-bar drive motor will change, and the control device controls the hook drive motor, based on not only the detected rotation speed of the needle-bar drive motor but also the obtained information. Thus, the hook drive motor is appropriately controlled to follow the changes of rotation speed of the needle-bar drive motor. Therefore, irrespective of whether a material being sewn may include a lapped portion or varying plies or thicknesses, the hook is rotated in synchronism with the reciprocation of the needle bar.

According to a preferred feature of the present invention, the information obtaining device comprises a load-change or load-fluctuation detector which detects an amount relating to a change or fluctuation of a load applied to the needle-bar drive motor. This amount may be, e.g., an output torque of the needle-bar drive motor or an electric current flowing through the needle-bar drive motor.

According to another feature of the present invention, the load-change detector comprises a torque detector which detects an output torque produced by the needle-bar drive motor. The output torque of the motor is an appropriate parameter with which an amount of change of rotation speed of the motor is predicated with high reliability. For example, if the resistance or load exerted to the sewing needle increases, the output torque of the motor increases and subsequently the rotation speed of the motor decreases. On the other hand, if the load exerted to the sewing needle decreases, the output torque of the motor decreases and then the rotation speed of the motor increases. Hence, the control device predicts the amount of change of rotation speed of the motor based on the detected output torque and controls the hook drive motor based on not only the detected rotation speed but also the predicted change amount of the rotation speed. The torque detector may comprise a current detector which detects an electric current flowing through the needle-bar drive motor, and means for determining the output torque based on the detected electric current. In the case where the sewing machine further comprises an upper shaft which is connected to an output shaft of the needle-bar drive motor and is rotatable for reciprocating the needle bar, the torque detector may comprise a torsion detector which detects an amount of torsion of the upper shaft.

According to another feature of the present invention, the load-change detector comprises a current detector which detects an electric current flowing through the needle-bar drive motor. The electric current flowing through the coil of the motor may be measured by using a current detector which has a simple construction. Thus, in the case where the load-change detector is provided by the current detector, the load-change detector enjoys a simple construction. Thus, the sewing machine as a whole may be produced with a simpler construction, at a lower cost, and in a smaller size.

According to another feature of the present invention, the control device comprises means for controlling the needle-bar drive motor so that the needle-bar drive motor rotates at a target rotation speed, and the information obtaining device comprises a device which obtains information indicative of an amount relating to a change of the target rotation speed. This information may comprise data indicative of an amount of change of rotation speed of the needle-bar drive motor, e.g., when stitching manners are changed between, e.g., straight stitching and zigzag stitching while a predetermined stitch pattern is formed by the sewing machine according to a batch of stitch-pattern sewing data. In this case, the sewing machine may further comprise an input device which is operable for inputting the target rotation speed.

According to another feature of the present invention, the sewing machine further comprises a phase detector which detects a rotation phase of the needle-bar drive motor, and the control device comprises means for controlling, based on the detected rotation phase of the needle-bar drive motor, the hook drive motor so that the hook drive motor rotates at a target rotation speed in synchronism with the rotation of the needle-bar drive motor, and means for modifying, based on the obtained information, the target rotation speed so that the hook drive motor rotates at the modified target rotation speed in synchronism with the rotation of the needle-bar drive motor whose speed has changed.

According to another feature of the present invention, the sewing machine further comprises a needle-bar connecting device which connects the needle bar to the needle-bar drive motor, the needle-bar connecting device comprising an upper shaft which is connected to an output shaft of the needle-bar drive motor and is rotatable for reciprocating the needle bar, and a hook connecting device which connects the hook to the hook drive motor, the hook connecting device comprising a lower shaft which is connected to an output shaft of the hook drive motor and is rotatable for rotating the hook.

According to another feature of the present invention, the control device comprises means for controlling, when the detected rotation speed of the needle-bar drive motor is less than a reference value, the hook drive motor based on the detected rotation speed of the needle-bar drive motor, without using the obtained information. While the needle-bar drive motor is rotated in a range of low speeds, the hook drive motor may appropriately follow the changes of rotation speed of the needle-bar drive motor, without relying upon the obtained information. Owing to this feature, the operation efficiency of the sewing machine is improved.

According to another feature of the present invention, the control device comprises means for controlling, when an amount of change of the rotation speed of the needle-bar drive motor indicated by the obtained information is less than a reference value, the hook drive motor based on the detected rotation speed of the needle-bar drive motor, without using the obtained information.

According to another feature of the present invention, the control device comprises means for controlling, based on the detected rotation speed of the needle-bar drive motor, the hook drive motor so that the hook drive motor rotates at a target rotation speed in synchronism with the rotation of the needle-bar drive motor, and means for modifying, based on the obtained information indicative of an amount of change of the rotation speed of the needle-bar drive motor, the target rotation speed, according to a predetermined relationship between amounts of modification of the target rotation speed and amounts of change of the rotation speed of the needle-bar drive motor, so that the hook drive motor rotates at the modified target rotation speed in synchronism with the rotation of the needle-bar drive motor whose speed has changed.

According to another feature of the present invention, the control means comprises correcting means for correcting the predetermined relationship with respect to at least an amount of modification of the target rotation speed which corresponds to the amount of change of the rotation speed of the needle-bar drive motor indicated by the obtained information, based on an actual amount of change of the rotation speed of the needle-bar drive motor detected by the speed detector and the amount of change of the rotation speed of the needle-bar drive motor indicated by the obtained information. The relationship is thus appropriately adapted to the actual conditions of the sewing machine. According to the relationship thus modified, the control device can more accurately predict an amount of change of the rotation speed of the needle-bar drive motor. This leads to improving the ability of the hook drive motor to follow the changes of rotation speed of the needle-bar drive motor and accordingly the ability of the sewing machine to synchronize the respective rotations of the two drive motors with each other. The correcting means may comprise means for incrementing or decrementing the amount of modification of the target rotation speed by a predetermined amount. Alternatively, the correcting means may comprise means for correcting the amount of modification of the target rotation speed, to a correct value corresponding to a relationship between the actual amount of change of the rotation speed of the needle-bar drive motor detected by the speed detector and the amount of change of the rotation speed of the needle-bar drive motor indicated by the obtained information.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which:

FIG. 2 is a flow chart representing a control program according to which the electronic control circuit of FIG. 1A controls the needle-bar and hook drive motors.

DETAILED DESCRIPTION OF THE PREFERRED EMBODIMENTS

Figure 1A:
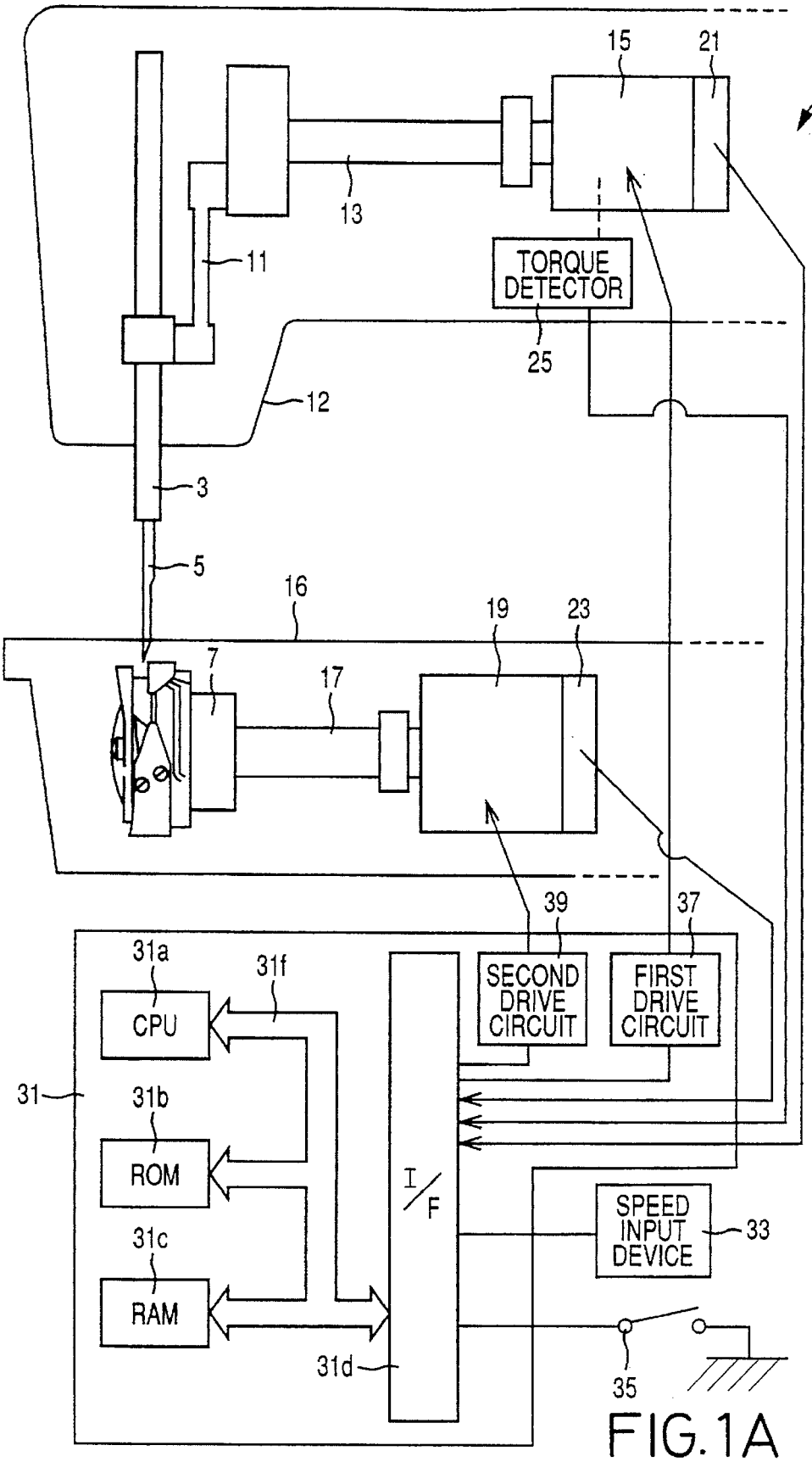
FIG. 1A is a diagrammatic view of a sewing machine embodying the present invention.

Referring first to FIG. 1A, there is shown a sewing machine 1 having a head portion 1*a* and a bed portion 16 provided below the head portion 1*a*. The head portion 1*a* supports a needle bar 3 such that the needle bar 3 can be moved upward and downward, i.e., reciprocated in a vertical direction. A sewing needle 5 conveying a needle thread (not shown) is secured to a lower end of the needle bar 3. In the bed portion 16, there is provided a hook 7 which supplies a bobbin thread (not shown) and catches a loop of the needle thread conveyed by the sewing needle 3 into the bed portion 16. The needle bar 3 and the hook 7 cooperate with each other to form stitches in a work sheet (not shown), such as a cloth or a leather, which is moved on an upper surface of the bed portion 16.

The needle bar 3 is connected via a crank 11 to one end of an upper shaft 13 and, as the upper shaft 13 is rotated, the needle bar 3 is reciprocated vertically. The other end of the upper shaft 13 is connected to a needle-bar drive motor 15. Thus, the upper shaft 13 is rotated by being driven by the needle-bar drive motor 15. The hook 7 is connected to one end of a lower shaft 17 and the other end of the lower shaft 17 is connected to a hook drive motor 19. Thus, the rotation of the hook drive motor 19 is transmitted to the hook 7 via the lower shaft 17. In the present embodiment, the drive motors 15, 19 are AC servo motors (i.e., brushless DC servo motors). However, the drive motors 15, 19 may be replaced by conventional DC servo motors (having a brush) or stepper motors. The two drive motors 15, 19 may be provided by different sorts of motors, respectively.

A first and a second encoder 21, 23 are associated with the needle-bar and hook drive motors 15, 19, respectively. Each encoder 21, 23 produces a pulse signal each time a corresponding motor 15, 19 rotates by a predetermined angle. The pulse signal is supplied from each encoder 21, 23 to an electronic control circuit 31. A torque detector 25 is also associated with the needle-bar drive motor 15. The torque detector 25 includes a current detector which detects or measures an electric current flowing through a coil of the motor 15, determines an output torque of the motor 15 based on the measured current, and supplies a detection signal representative of the determined torque, to the control circuit 31. Alternatively, the control circuit 31 may be adapted to determine the torque of the motor 15 based on a signal representative of the electric current measured by the current detector 25. The output torque of the motor 15 is substantially proportional to the electric current flowing through the coil thereof. The control circuit 31 determines, based on the pulse signal supplied from each encoder 21, 23, a current rotation speed and a current rotation angle or phase of a corresponding motor 15, 19.

The electronic control circuit 31 is provided by a microcomputer which is essentially comprised of a central processing unit (CPU) 31*a*, a read only memory (ROM) 31*b*, a random access memory (RAM) 31*c*, an interface (I/F) 31*d*, and a bus 31*f*. The CPU 31*a* carries out various control operations. The ROM 31*b* permanently stores various control programs including a motor-drive control program represented by the flow chart shown in FIG. 2. The RAM 31*c* temporarily stores various data including the pulse signals supplied from the encoders 21, 23 and the detection signal supplied from the torque detector 25. All signals or data are input to, and output from, the interface 31*d*. The bus 31*f* electrically connects the CPU 31*a*, ROM 31*b*, RAM 31*c*, and interface 31*d* with one another so that signals or data are input to, and output from, each element 31*a*, 31*b*, 31*c*, 31*d*.

The control circuit 31 is also connected to a speed input device 33 and a start/stop switch 35 which are provided on an operator's panel (not shown) of the sewing machine 1, and receives signals supplied from those elements 33, 35. The control circuit 31 controls the needle-bar drive motor 15 and the hook drive motor 19 via a first and a second drive circuit 37, 39, respectively, according to the motor-drive control program represented by the flow chart of FIG. 2, based on the various signals supplied from the elements 21, 23, 25, 33, 35.

Figure 1B:
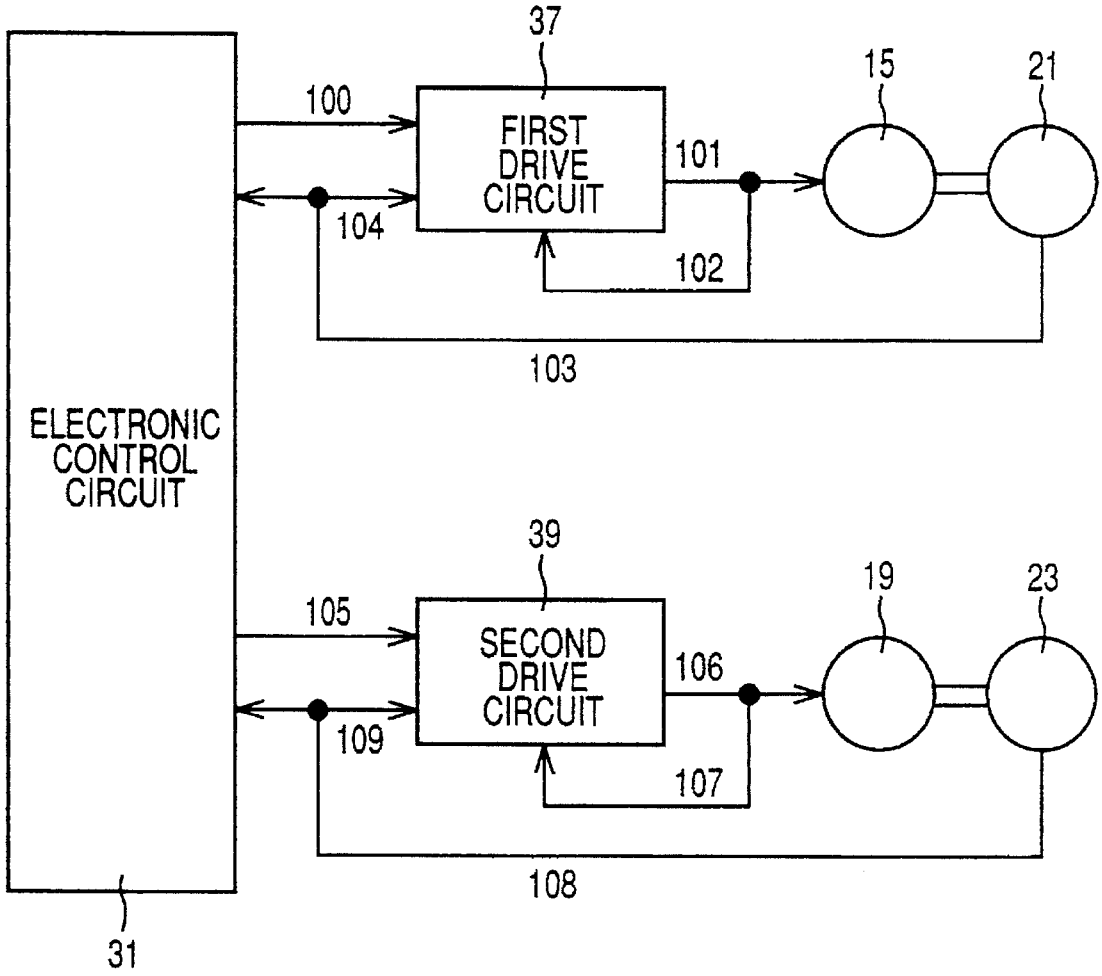
FIG. 1B is a view for illustrating the manner in which an electronic control circuit of the sewing machine of FIG. 1A controls a needle-bar and a hook drive motor via respective drive circuits and encoders.

FIG. 1B shows in more detail the manner in which the control circuit 31 controls each of the two drive motors 15, 19 so that each motor 15, 19 is rotated at a target rotation speed corresponding to an operator's desirable speed input through the speed input device 33, and the manner in which the control circuit 31 controls the two drive motors 15, 19 so that the two motors 15, 19 are rotated in synchronism with each other.

The control circuit 31 supplies the first drive circuit 37 with a command signal 100 carrying information indicative of a rotation speed and a rotation amount or angle. The first drive circuit 37 receives the command signal 100 and supplies the needle-bar drive motor 15 with a drive current 101. Thus, the motor 15 is rotated at the commanded speed and by the commanded angle. The first encoder 21 is mechanically and coaxially connected to the motor 15. As described above, the encoder 21 produces a pulse signal 103 each time the motor 15 rotates by a predetermined angle. Therefore, as the rotation speed of the motor 15 increases, the number of electric pulses 103 produced by the encoder 21 in unit time increases, and vice versa.

A feedback signal 104 from the pulse signal 103 is supplied to the drive circuit 37, and a speed control loop of the drive circuit 37 controls the rotation speed of the motor 15 so that the motor 15 is rotated at the speed indicated by the command signal 100. In addition, a feedback signal 102 in the form of a control signal converted from the drive current 101 is supplied to the drive circuit 37, so that the feedback signal 102 is utilized to control the output torque and rotation speed of the motor 15.

The pulse signal 103 produced from the encoder 21 is input to the control circuit 31. While the rotation speed of the needle-bar drive motor 15 is lower than a reference value, the control circuit 31 supplies the second drive circuit 39 with the received pulse signal 103 as it is as a command signal 105 directed to the hook drive motor 19. Regarding the other operations, the control circuit 31 controls the hook drive motor 19 by using lines 106, 107, 108, 109, in the same manner as described above for the needle-bar drive motor 15. Accordingly, the two drive motors 15, 19 are rotated in synchronism with each other. The control circuit 31 can determine the current rotation angle or phase of each motor 15, 19 by counting the number of electric pulses 103, 108 supplied from the encoder 21, 23 after receiving a reference signal indicative of a reference angle or phase.

Hereinafter, there will be described the operation of the electronic control circuit 31 for controlling the needle-bar and hook drive motors 15, 19, by reference to the flow chart of FIG. 2 and the correction map shown in the graph of FIG. 3.

The control circuit 31 starts with Step S01 when the start/stop switch 35 is operated to an ON state thereof. At Step S01, the CPU 31*a* reads or determines an actual rotation speed of the upper shaft 13 or the needle-bar drive motor 15 based on the pulse signal 103 supplied from the first encoder 21. Step S01 is followed by Step S03 to determine a target rotation speed of the motor 15 such that the target speed corresponds to an operator's desirable speed input through the speed input device 33, and additionally determine a target rotation speed of the lower shaft 17 or the hook drive motor 19 such that the target speed corresponds to the actual rotation speed of the motor 15 read at Step S01. Then, the control circuit 31 controls respective voltages to be supplied to the two motors 15, 19, according to another control program (not shown), so that the motors 15, 19 are rotated at the determined target speeds, respectively.

Step S03 is followed by Step S05 to judge whether the rotation speed of the motor 15 read at Step S01 is less than a reference value. If a positive judgment is made at Step S05, the control of the CPU 31*a* goes back to Step S01. On the other hand, if a negative judgment is made, the control goes to Step S07 to read the output torque of the needle-bar drive motor 15 via the torque detector 25 and store the read value in the RAM 31*c*. Step S07 is followed by Step S09 to judge whether an amount of change of the output torque of the motor 15 read at Step S07 in the current control cycle, from that read in the preceding control cycle, falls outside a reference range. In the present embodiment, a positive judgment is made if a ratio of the output torque read in the current control cycle to that read in the preceding control cycle does not fall within the predetermined range of $1\pm\alpha$ ($\alpha$ is a small positive value).

If a negative judgment is made at Step S09, the control of the CPU 31*a* goes back to Step S01. On the other hand, if a positive judgment is made, the control goes to Step S11 to modify the target rotation speed of the lower shaft 17 or the hook drive motor 19 determined at Step S03, according to the correction map shown in the graph of FIG. 3. For example, an increase of the output torque of the needle-bar drive motor 15 indicates that the resistance or load applied to the motor 15 via the sewing needle 5 and the needle bar 3 has increased. In this case, it can be expected or speculated that the rotation speed of the motor 15 will abruptly decrease. The correction map of FIG. 3 represents a relationship between amounts of modification or correction of the target rotation speed of the lower shaft 17 (or the hook drive motor 19) and amounts of change of the output torque of the needle-bar drive motor 15. According to this correction map, the amounts of correction of the target rotation speed of the motor 19 monotonously increases with the amounts of change of the output torque of the motor 15. In the case of an increase of the output torque of the motor 15, the control circuit 31 determines an amount of correction of the target rotation speed of the motor 19 which amount corresponds to the increased amount of the output torque of the motor 15 determined at Step S09, according to the correction map of FIG. 3, and modifies the target rotation speed of the motor 19 determined at Step S03, by subtracting, therefrom, the thus determined amount of correction. On the other hand, in the case of a decrease of the output torque of the motor 15, the control circuit 31 determines an amount of correction of the target rotation speed of the motor 19 which amount corresponds to the decreased amount of the output torque of the motor 15 determined at Step S09, according to a similar correction map (not shown), and modifies the target rotation speed of the motor 19 determined at Step S3, by adding, thereto, the thus determined amount of correction. A common correction map may be used for both the cases of increase and decrease of the output torque of the motor 15. Then, the control circuit 31 controls the hook drive motor 19 so that the motor 19 and the lower shaft 17 or hook 7 is rotated at the thus modified target speed.

Step S11 is followed by Step S13 to read the respective current rotation speeds and phases of the two drive motors 15, 19 based on the pulse signals 103, 108 supplied from the two encoders 21, 23. At the following Step S15, the CPU 31*a* judges whether the hook drive motor 19 is being rotated in synchronism with the rotation of the needle-bar drive motor 15 whose speed should have changed. For example, a positive judgment is made if the rotation phase of the hook drive motor 19 falls within a predetermined range whose middle value is equal to the rotation phase of the needle-bar drive motor 15. If a positive judgment is made at Step S15, the control of the CPU 31*a* goes back to Step S07. On the other hand, if a negative judgment is made, the control goes to Step S17 to modify the correction map of FIG. 3, and then goes back to Step S11. More specifically, the control circuit 31 or the CPU 31*a* determines an amount of change of the rotation speed of the needle-bar drive motor 15 from the respective rotation speeds read at Steps S01 and S13, and determines a relationship of correspondence between the thus determined change amount of the rotation speed of the motor 15 and the amount of change of the output torque of the motor 15 determined at Step S09. Next, the CPU 31*a* corrects the correction map of FIG. 3 with respect to an amount of correction of the lower-shaft target rotation speed which corresponds to the determined change amount of the output torque of the motor 15, to a correct value corresponding to the determined relationship. Otherwise, the CPU 31*a* may be adapted to modify the correction map by incrementing or decrementing, by a predetermined small amount at each time, an amount of correction of the lower-shaft target rotation speed which corresponds to the determined change amount of the output torque of the motor 15.

In either case, while Steps S11 through S17 are iteratively carried out, the correction map is corrected at Step S17 in each control cycle, so that the target rotation speed of the hook drive motor 19 may appropriately be corrected at Step S11. Accordingly, the lower shaft 17 or the hook drive motor 19 is rotated in synchronism with the rotation of the upper shaft 13 or needle-bar drive motor 15. Thus, a positive judgment is made at Step S15 and the control of the CPU 31*a* goes back to Step S07. If large changes of the output torque of the needle-bar drive motor 15 continue, a positive judgment is made at Step S09, so that Step S11 through Step S17 are repeated. On the other hand, if not, a negative judgment is made at Step S09, and the control goes back to Step S01. If thereafter no large torque change is detected at Step S09, Steps S01 through S09 are repeated. That is, the target rotation speed of the lower shaft 17 employed at Step S03 is used as it is, without being modified at Step S11.

As is apparent from the foregoing description, in the present sewing machine 1, the control circuit 31 or the CPU 31*a* modifies the target rotation speed of the lower shaft 17 or the hook drive motor 19 based on the amount of change of the output torque of the needle-bar drive motor 15. Thus, the hook drive motor 19 is so controlled as to follow, with high reliability, the changes of rotation speed of the needle-bar drive motor 15. Irrespective of whether a material being sewn may include a lapped portion or varying plies or thicknesses, the lower shaft 17 or the hook 7 may be rotated while keeping the synchronism with the rotation of the upper shaft 13, i.e., reciprocation of the needle bar 3.

Figure 3:
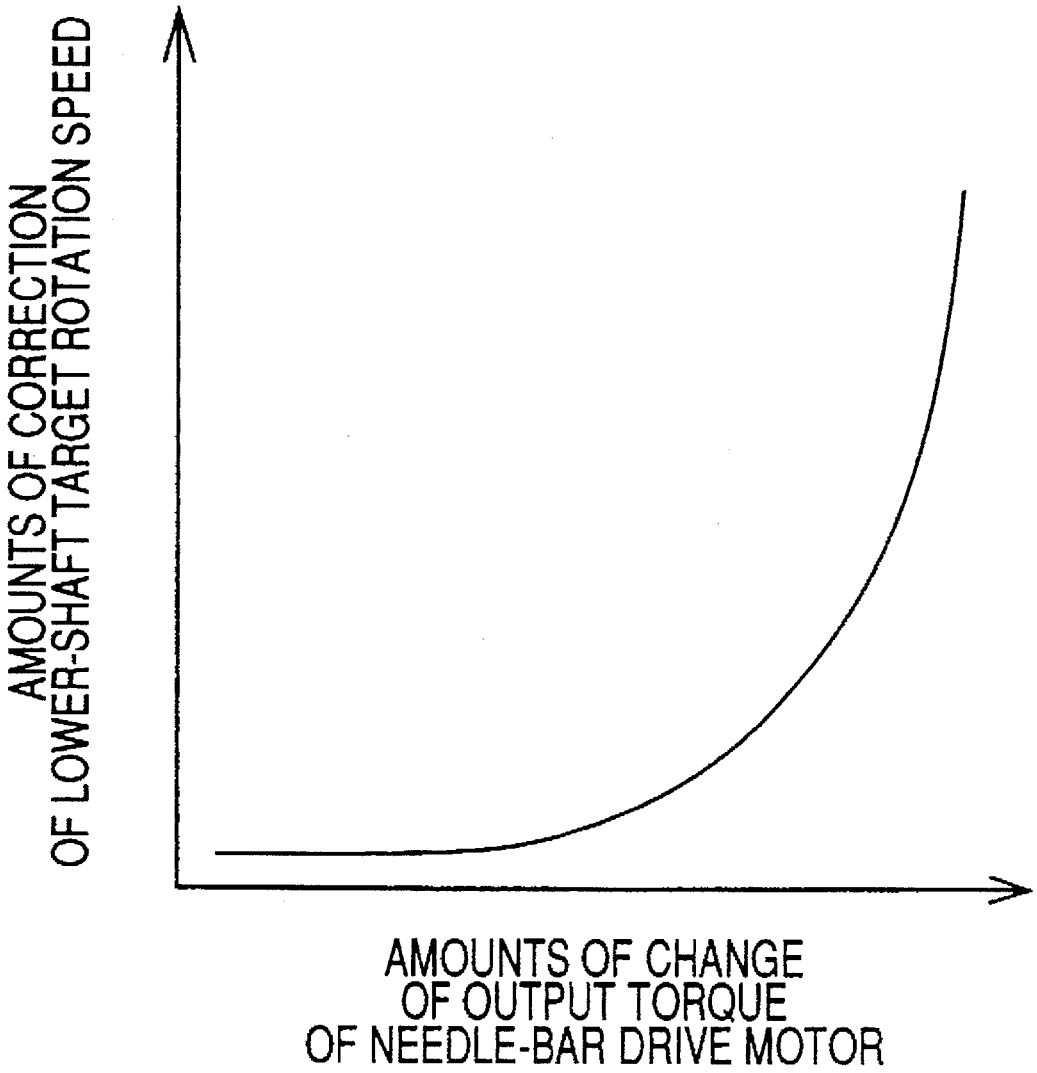
FIG. 3 is a graph representing a relationship between the amounts of correction of a target lower-shaft rotation speed and the amounts of change of output torque of the needle-bar drive motor.

In addition, since the correction map of FIG. 3 is modified by learning at Step S17, the map is well adapted to the actual conditions of the sewing machine 1. According to the thus modified map, the control circuit 31 can more accurately predict the amount of an imminent change of the rotation speed of the upper shaft 13. This leads to improving the ability of the hook drive motor 19 to follow the changes of rotation speed of the needle-bar drive motor 15 and therefore the ability of the sewing machine 1 to synchronize the respective rotations of the two drive motors 15, 19 with each other.

In the present embodiment, if a negative judgment is made at Step S05, i.e., the rotation speed of the upper shaft 13 read at Step S01 is less than a reference value, the target rotation speed of the lower shaft 17 calculated at Step S03 is used as it is without being modified. The reason is such that while the needle-bar drive motor 15 is rotated at low speeds, the hook drive motor 19 can well follow the changes of rotation speed of the motor 15, without needing any modification of the target rotation speed determined therefor. In this case, Steps S07 through S17 are skipped and the operation efficiency of the sewing machine 1 is improved.

In the present embodiment, the torque detector 25 measures the electric current flowing through the coil of the needle-bar drive motor 15, and determines the output torque of the motor 15 based on the measured current. The torque detector 25 may otherwise be provided by a torsion sensor which detects an amount of torsion of the upper shaft 13, or any of other sorts of known sensors. However, the electric current flowing through the coil of the motor 15 can be measured by using a current detector which has a simple construction . Thus, in the case where the torque detector 25 is provided by the current detector, the torque detector 25 enjoys a simple construction. Thus, the sewing machine 1 as a whole can be produced with a simpler construction, at a lower cost, and in a smaller size.

The target rotation speed of the lower shaft 17 may be modified directly based on the electric current measured by a current detector employed as a load-fluctuation detector for detecting an amount relating to a change of a load applied to the needle-bar drive motor 15.

Moreover, in the case where the present sewing machine 1 is adapted to producing a stitch pattern according to a stitch-pattern sewing data stored in the ROM **31*b* and the stitch-pattern sewing data include speed-change data indicative of a change of rotation speed of the needle-bar drive motor 15 when stitching manners are changed between, e.g., straight stitching and zigzag stitching, the CPU 31*a* of the control circuit 31 may be adapted to modify the target rotation speed of the lower shaft 17 based on the speed-change data. In the last case, the control circuit 31 serves as an information obtaining device for obtaining information indicating that the rotation speed of the needle-bar drive motor 15 will change. The above described torque detector 25**, torsion sensor, and current detector all serve as the information obtaining device.

While the present invention has been described in its preferred embodiments, it is to be understood that the present invention may otherwise be embodied.

For example, while in the illustrated embodiment the encoders 21, 23 are employed for detecting the respective rotation speeds of the drive motors 15, 19, the encoders 21, 23 may be replaced by other sorts of speed detectors or sensors. In addition, the correction map of FIG. 3 may be replaced by other sorts of maps. Otherwise, the target rotation amount of the lower shaft 17 may be modified by employing a function expression in place of a correction map.

It is to be understood that the present invention may be embodied with other changes, improvements, and modifications that may occur to those skilled in the art without departing from the spirit and scope of the invention defined in the appended claims.

What is claimed is:

1. A sewing machine comprising:

a needle bar to which a sewing needle is secured;

a needle-bar drive motor which reciprocates said needle bar;

a hook;

a hook drive motor which rotates said hook;

a speed detector which detects a rotation speed of said needle-bar drive motor;

an information obtaining device which obtains information indicating that the rotation speed of said needle-bar drive motor will change; and a control device which controls, based on the detected rotation speed of said needle-bar drive motor and the obtained information, said hook drive motor at least when the detected rotation speed of said needle drive motor is greater than a reference value so that said hook is rotated in synchronism with the reciprocation of said needle bar.

2. A sewing machine according to claim 1, wherein said information obtaining device comprises a load-change detector which detects an amount relating to a change of a load applied to said needle-bar drive motor.

3. A sewing machine according to claim 2, wherein said load-change detector comprises a torque detector which detects an output torque produced by said needle-bar drive motor.

4. A sewing machine according to claim 3, wherein said torque detector comprises a current detector which detects an electric current flowing through said needle-bar drive motor, and means for determining said output torque based on the detected electric current.

5. A sewing machine according to claim 3, further comprising an upper shaft which is connected to an output shaft of said needle-bar drive motor and is rotatable for reciprocating said needle bar, and wherein said torque detector comprises a torsion detector which detects an amount of torsion of said upper shaft.

6. A sewing machine according to claim 2, wherein said load-change detector comprises a current detector which detects an electric current flowing through said needle-bar drive motor.

7. A sewing machine according to claim 1, wherein said control device comprises means for controlling said needle-bar drive motor so that the needle-bar drive motor rotates at a target rotation speed, and wherein said information obtaining device comprises a device which obtains information indicative of an amount relating to a change of said target rotation speed.

8. A sewing machine according to claim 7, further comprising an input device which is operable for inputting said target rotation speed.

9. A sewing machine according to claim 1, further comprising a phase detector which detects a rotation phase of said needle-bar drive motor, and wherein said control device comprises means for controlling, based on the detected rotation phase of said needle-bar drive motor, said hook drive motor so that the hook drive motor rotates at a target rotation speed in synchronism with the rotation of said needle-bar drive motor, and means for modifying based on said obtained information, said target rotation speed so that said hook drive motor rotates at the modified target rotation speed in synchronism with the rotation of said needle-bar drive motor whose speed has changed.

10. A sewing machine according to claim 1, further comprising:

a needle-bar connecting device which connects said needle bar to said needle-bar drive motor, said needle-bar connecting device comprising an upper shaft which is connected to an output shaft of said needle-bar drive motor and is rotatable for reciprocating said needle bar; and a hook connecting device which connects said hook to said hook drive motor, said hook connecting device comprising a lower shaft which is connected to an output shaft of said hook drive motor and is rotatable for rotating said hook.

11. A sewing machine according to claim 1, wherein said control device comprises means for controlling, when said detected rotation speed of said needle-bar drive motor is less than the reference value, said hook drive motor based on the detected rotation speed of the needle-bar drive motor, without using said obtained information.

12. A sewing machine according to claim 1, wherein said control device comprises means for controlling, when an amount of change of said rotation speed of said needle-bar drive motor indicated by said obtained information is less than a reference value, said hook drive motor based on said detected rotation speed of said needle-bar drive motor, without using said obtained information.

13. A sewing machine according to claim 1, wherein said control device comprises means for controlling, based on said detected rotation speed of said needle-bar drive motor, said hook drive motor so that the hook drive motor rotates at a target rotation speed in synchronism with the rotation of said needle-bar drive motor, and means for modifying, based on said obtained information indicative of an amount of change of said rotation speed of said needle-bar drive motor, said target rotation speed, according to a predetermined relationship between amounts of modification of said target rotation speed and amounts of change of said rotation speed of said needle-bar drive motor, so that said hook drive motor rotates at the modified target rotation speed in synchronism with the rotation of said needle-bar drive motor whose speed has changed.

14. A sewing machine according to claim 13, wherein said control means comprises correcting means for correcting said predetermined relationship with respect to at least an amount of modification of said target rotation speed which corresponds to said amount of change of said rotation speed of said needle-bar drive motor indicated by said obtained information, based on an actual amount of change of said rotation speed of said needle-bar drive motor detected by said speed detector and said amount of change of the rotation speed of the needle-bar drive motor indicated by said obtained information.

15. A sewing machine according to claim 14, wherein said correcting means comprises means for incrementing or decrementing said amount of modification of said target rotation speed by a predetermined amount.

16. A sewing machine according to claim 14, wherein said correcting means comprises means for correcting said amount of modification of said target rotation speed, to a correct value corresponding to a relationship between said actual amount of change of said rotation speed of said needle-bar drive motor detected by said speed detector and said amount of change of the rotation speed of the needle-bar drive motor indicated by said obtained information.

* * * * *